US007419210B2

(12) United States Patent
Nolan et al.

(10) Patent No.: US 7,419,210 B2
(45) Date of Patent: Sep. 2, 2008

(54) HIGH CHAIR

(75) Inventors: Patrick Nolan, Royersford, PA (US); James Murray Forbes Hutchinson, Mohnton, PA (US); Michael L. Longenecker, Lancaster, PA (US); Myles Christensen, Pueblo West, CO (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 11/567,057

(22) Filed: Dec. 5, 2006

(65) Prior Publication Data

US 2007/0096527 A1 May 3, 2007

Related U.S. Application Data

(62) Division of application No. 10/803,086, filed on Mar. 18, 2004, now abandoned.

(60) Provisional application No. 60/457,325, filed on Mar. 26, 2003.

(51) Int. Cl.
*A47B 83/02* (2006.01)

(52) U.S. Cl. ..... 297/153; 297/148; 297/149

(58) Field of Classification Search ..... 297/344.12, 297/148, 149, 151, 153
See application file for complete search history.

(56) References Cited

U.S. PATENT DOCUMENTS

| | | | |
|---|---|---|---|
| 2,590,253 | A | 3/1952 | Kelley |
| 2,845,993 | A | 8/1958 | Eads et al. |
| 2,979,118 | A | 4/1961 | Gelman |
| 2,982,285 | A | 5/1961 | Lowell |
| 3,345,105 | A | 10/1967 | Levy et al. |
| 4,603,902 | A | 8/1986 | Maloney |
| 4,844,537 | A | 7/1989 | Reed |
| 5,082,327 | A | 1/1992 | Crisp |
| 5,096,249 | A | 3/1992 | Hines |
| 5,110,182 | A | 5/1992 | Beauvais |
| 5,316,370 | A | 5/1994 | Newman |
| 5,332,241 | A | 7/1994 | Rho |
| 5,489,138 | A | 2/1996 | Mariol et al. |
| 5,558,400 | A | 9/1996 | Poulson et al. |

(Continued)

FOREIGN PATENT DOCUMENTS

| | | |
|---|---|---|
| DE | 28 45 983 A1 | 4/1980 |

(Continued)

OTHER PUBLICATIONS

Paten Abstracts of Japan, vol. 1995, No. 8, Sep. 29, 1995.

*Primary Examiner*—David R Dunn
*Assistant Examiner*—Erika Garrett
(74) *Attorney, Agent, or Firm*—Lempia Braidwood LLC

(57) ABSTRACT

A high chair features various modes of adjustability and enhanced utility. The height of the chair can be adjusted using a single hand that engages a rear handle. The height of a seat platform of the chair can be adjusted separately relative to the tray. The tray itself is ergonomically designed for the benefit of the caregiver. A removable tray liner facilitates after-meal clean-up. Wheels on the underside of the tray ease fore/aft adjustment. A pivoting back rest of the chair minimizes rearward shift of the center of gravity of the occupied chair, thus requiring a smaller chair footprint. Further, an accessory bar pivoted to a seat back portion of the chair provides readily accessible entertainment.

9 Claims, 21 Drawing Sheets

U.S. PATENT DOCUMENTS

| | | | | |
|---|---|---|---|---|
| 5,695,248 | A | 12/1997 | Bell | |
| 5,782,536 | A * | 7/1998 | Heidmann et al. | 297/440.15 |
| 5,810,432 | A | 9/1998 | Haut et al. | |
| 5,810,436 | A | 9/1998 | Surot | |
| 5,820,207 | A | 10/1998 | Wang | |
| 5,823,615 | A | 10/1998 | Haut | |
| 5,992,932 | A * | 11/1999 | Kain et al. | 297/153 |
| 6,021,914 | A | 2/2000 | Schmidt | |
| 6,050,643 | A * | 4/2000 | Kain et al. | 297/344.18 |
| 6,089,653 | A | 7/2000 | Hotaling et al. | |
| 6,113,188 | A | 9/2000 | Stewart et al. | |
| 6,126,236 | A | 10/2000 | Wu | |
| D443,777 | S | 6/2001 | Flannery et al. | |
| 6,299,249 | B1 * | 10/2001 | Mori | 297/256.13 |
| 6,347,833 | B1 | 2/2002 | Chen | |
| 6,416,124 | B1 | 7/2002 | Chen et al. | |
| 6,419,312 | B1 | 7/2002 | Flannery et al. | |
| 6,428,099 | B1 * | 8/2002 | Kain | 297/256.1 |
| 6,497,452 | B2 | 12/2002 | Catelli | |
| 6,631,950 | B1 | 10/2003 | Madole | |
| 6,666,505 | B2 | 12/2003 | Greger et al. | |
| 6,692,070 | B1 | 2/2004 | Hou et al. | |
| 6,702,383 | B2 | 3/2004 | Newman et al. | |
| 6,705,675 | B1 * | 3/2004 | Eastman et al. | 297/250.1 |
| 6,715,827 | B1 | 4/2004 | Cheng | |
| 2003/0015903 | A1 | 1/2003 | Myers | |
| 2003/0151285 | A1 | 8/2003 | Keegan | |
| 2003/0197403 | A1 | 10/2003 | Greger | |

FOREIGN PATENT DOCUMENTS

| | | | |
|---|---|---|---|
| DE | 202 04 165 | U | 7/2002 |
| DE | 202 15 784 | U1 | 3/2003 |
| DE | 203 10 316 | U | 9/2003 |
| EP | 1 277 423 | A1 | 1/2003 |
| FR | 2 333 472 | A1 | 7/1977 |
| GB | 2 402 055 | A | 12/2004 |
| JP | 7-124040 | | 5/1995 |
| WO | WO 01/54485 | A1 | 8/2001 |

* cited by examiner

HIGH CHAIR

CROSS-REFERENCE TO RELATED PATENT APPLICATIONS

This application is a division of U.S. patent application Ser. No. 10/803,086, filed on Mar. 18, 2004, which claims the benefit of U.S. provisional application No. 60/457,325, the disclosure of each of which is incorporated herein by reference in its entirety.

BACKGROUND OF THE INVENTION

1. Field of the Disclosure

The present invention relates to seating for children and, in particular, to high chairs.

2. Description of Related Art

High chairs have been provided with a myriad of features designed to enhance their comfort, safety and convenience. There is room for improvement, however, as to several aspects of high chair design. This invention addresses these needs.

During the course of attending to a child in a highchair, it is common practice for the caregiver to sit in front of the highchair and rest his or her arms on the high chair tray. High chair trays typically are made of a relatively hard, unforgiving material and do not provide a comfortable resting place for the caregiver's arms.

The tray of a high chair can become extremely soiled by an infant while eating. Often relatively large food chunks remain on the surface of the tray. The effective and controlled removal of this debris is not adequately addressed in the prior art.

The position of a high chair tray often requires adjustment. Often the tray sticks, or does not slide easily on the surface of the highchair on which it bears.

High chairs that allow the height of the chair to be adjusted require the use of two hands to make the adjustment. Busy caregivers often find that only one hand is free for making a height adjustment. This requires the caregiver first to free up one hand before the adjustment can be made.

Stringent stability (tipping) regulations have a direct impact on the footprint geometry of a high chair. Generally speaking, consumers prefer to have a high chair with a small footprint so that it can be integrated into the kitchen or table setting more conveniently. The footprint size, which is governed by stability concerns, is necessarily larger in high chairs that have a recline feature. Because a child's head comprises a significant proportion of his or her body weight, in reclining high chairs the center of gravity can move substantially to the rear as the child is moved from a full upright to a reclining position. Thus it is highly desirable to minimize the shift of the center of gravity when the seat back is reclined, whereby the footprint of the high chair can be minimized.

Recline mechanisms that allow the seat back to pivot at the bight portion of the seat usually cause a change in the distance between the seat back and the crotch support of the armbar as the seat is moved through various recline positions. This distance is regulated by industry standards, and it is highly desirable to be able to vary the angle of the seat back without significantly altering the distance between the seat back and the crotch support.

Children typically utilize high chairs throughout a relatively large age span. The wide range of physical development that a child undergoes during this time presents a formidable challenge to designing a high chair that ideally accommodates all of the physical needs of the child. This situation is exacerbated by high chairs that have recline features, enabling the unit to be used for very young infants, and removable arm bars, which when removed allow the chair to be pulled right up to a table for use by an older child. One aspect of available high chairs that does not adequately address this need is the seat height relative to the tray. Most high chairs are designed to accommodate the older child, which means that the tray is usually higher than optimal for an infant or a toddler.

Finally, a consumer-preferred feature is to have entertainment value readily available for a child in a high chair. Often after a meal it is desirable to keep the child in the high chair and quickly occupy the child with interesting objects that cannot be thrown to the floor.

SUMMARY OF THE INVENTION

In accordance with one aspect of the present invention, a height-adjustable child high chair is provided. The chair includes a seat having a seat bottom portion and a seat back portion. The seat bottom portion has a downwardly extending leg rest portion. A floor-engaging frame supports the seat. The frame supports the leg rest portion such that the leg rest portion is slidable relative to the frame. The chair further includes a seat height adjustment mechanism facilitating vertical movement of the seat relative to the frame.

It should be appreciated that the foregoing and other aspects of the invention will appear from the following description. In the description, reference is made to the accompanying drawings which form a part thereof, and in which there is shown by way of illustration, and not limitation, preferred embodiments of the invention. Such embodiments do not necessarily represent the fill scope of the invention, and reference must therefore be made to the claims herein for interpreting the full scope of the invention.

BRIEF DESCRIPTION OF THE DRAWINGS

The above and other features, aspects and advantages of the invention will become apparent from the following detailed description and the accompany exemplary embodiments shown in the drawing figures, in which.

Figure 1:
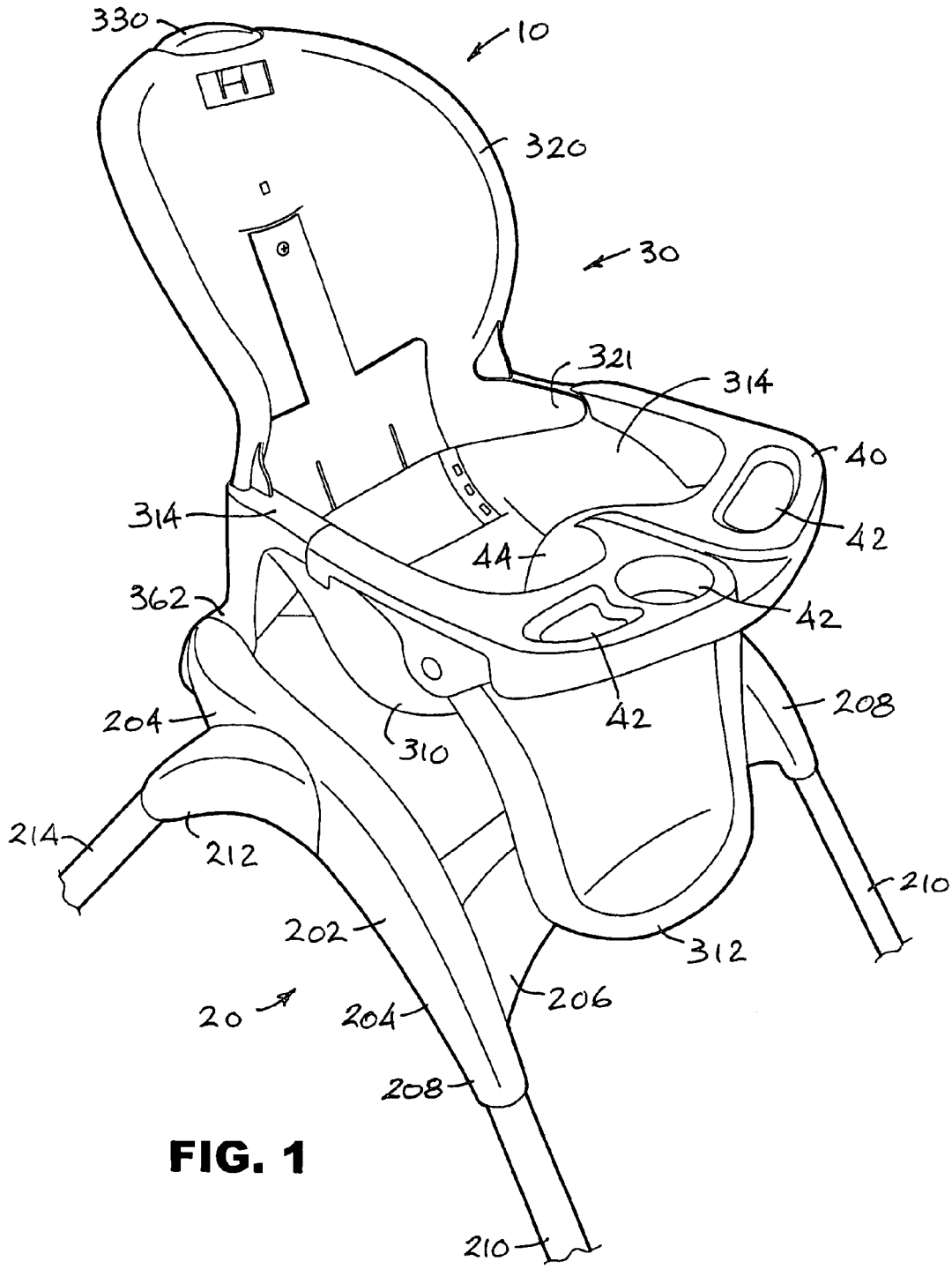
FIG. 1 is a top perspective view of a high chair according to the invention.

It is to be understood that the invention is not limited in its application to the details of construction and the arrangement of components described below and illustrated in the drawing figures. Those skilled in the art will recognize that various modifications can be made without departing from the scope of the invention, which is defined by the appended claims.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

Figure 6:
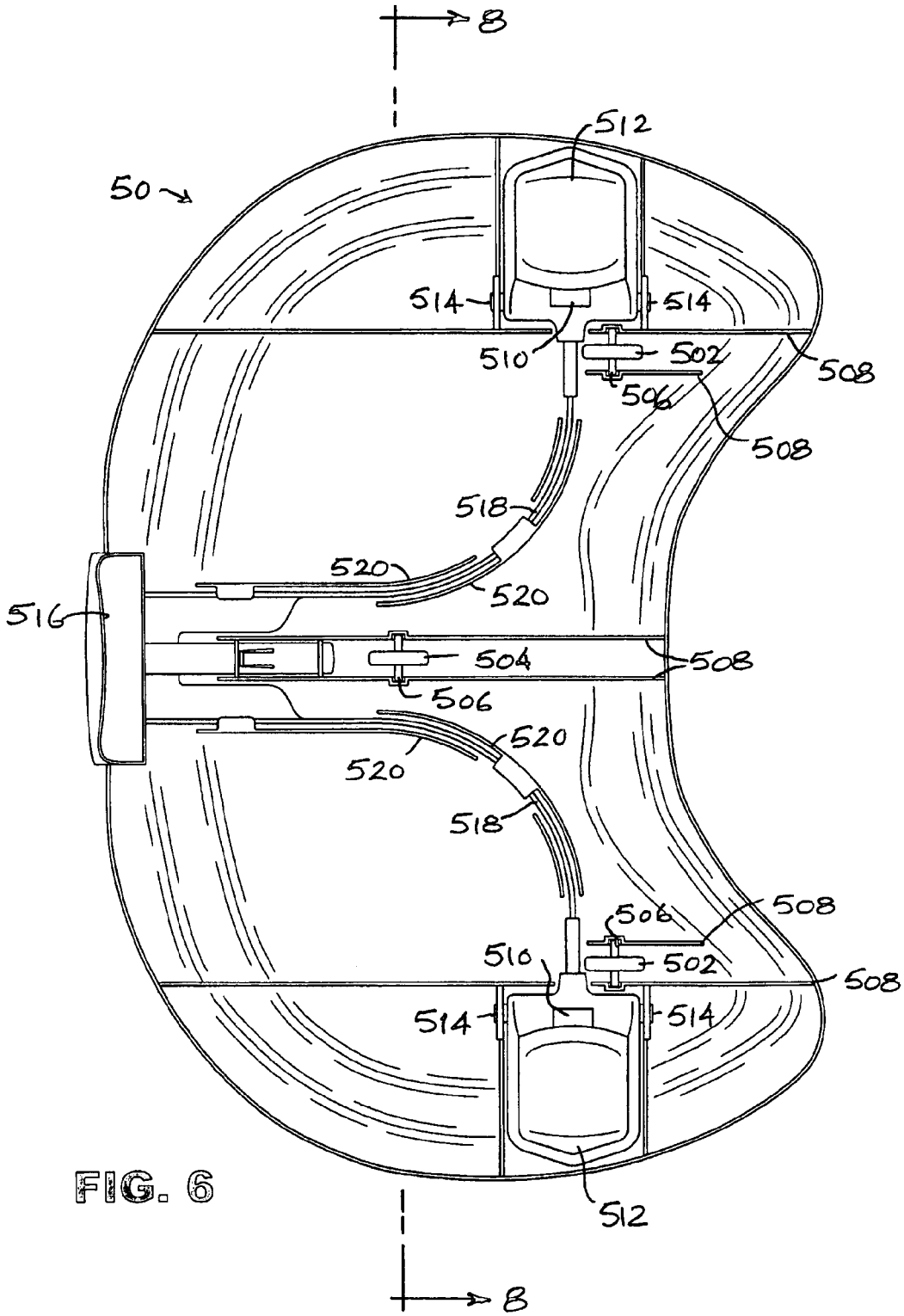
FIG. 6 is a bottom plan view of a tray according to the invention.
Figure 8:
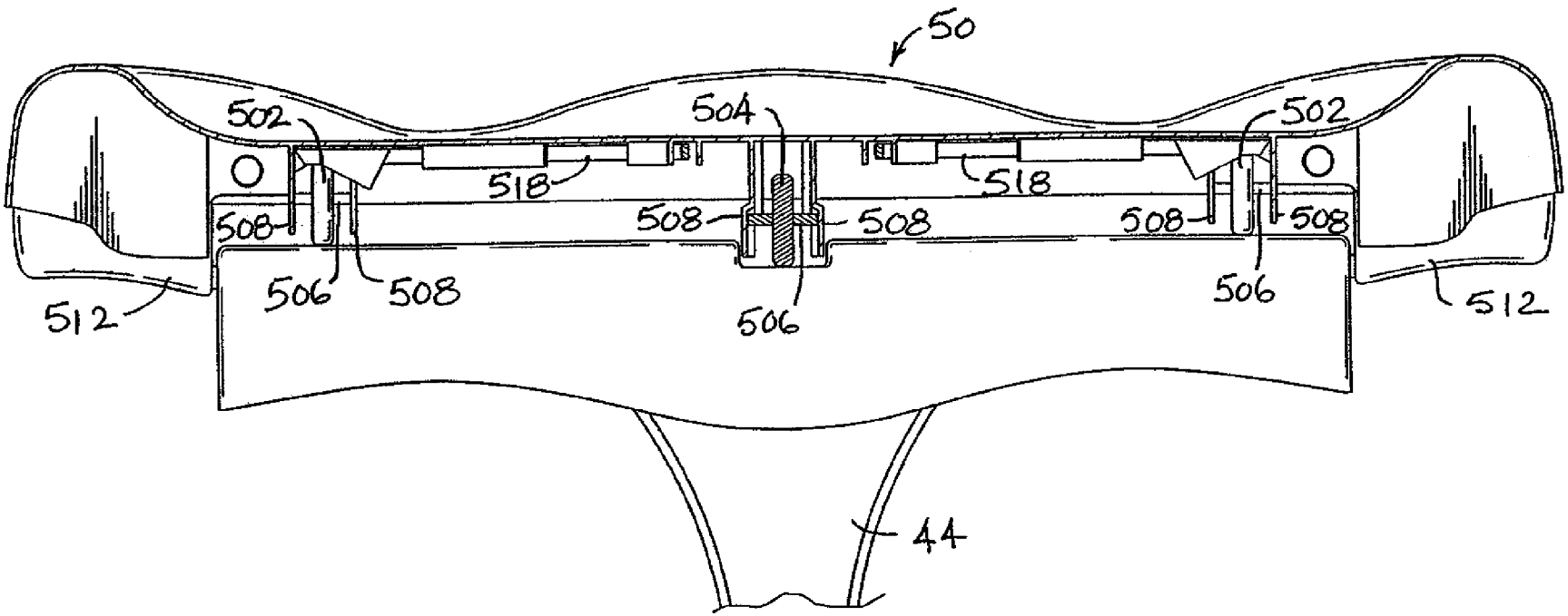
FIG. 8 is a cross-sectional view of the tray taken along line 8-8 in FIG. 6.

FIG. 1 generally shows a high chair 10 according to the invention, which comprises a floor-standing frame 20 supporting a seat 30. A removable arm bar 40 on the seat supports a removable tray 50 (see FIGS. 2, 6, 8).

Frame 20 has an integrally molded plastic chassis 202 with spaced side portions 204 interconnected by a front cross member 206. Chassis 202 also has fixed front leg sockets 208, which receive tubular front legs 210, and pivoting rear leg sockets 212, which receive tubular rear legs 214. Floor-engaging feet or casters (not shown) are provided at the bottom ends of legs 210, 214. The pivoting nature of rear leg sockets 212 enables the rear legs 214 to be folded for more compact storage when the high chair is not in use.

Seat 30 comprises a molded plastic seat bottom portion 310 adjustably supported on chassis 20, and a molded plastic seat back portion 320 pivoted to seat bottom portion 310. Seat bottom portion 310 has an integrally molded leg rest portion 312, and integrally molded armrest portions 314. Seat 30 is depicted as a bare shell, it being understood that a padded covering (not shown) would normally be used to enhance the comfort of the seat.

Figure 7:
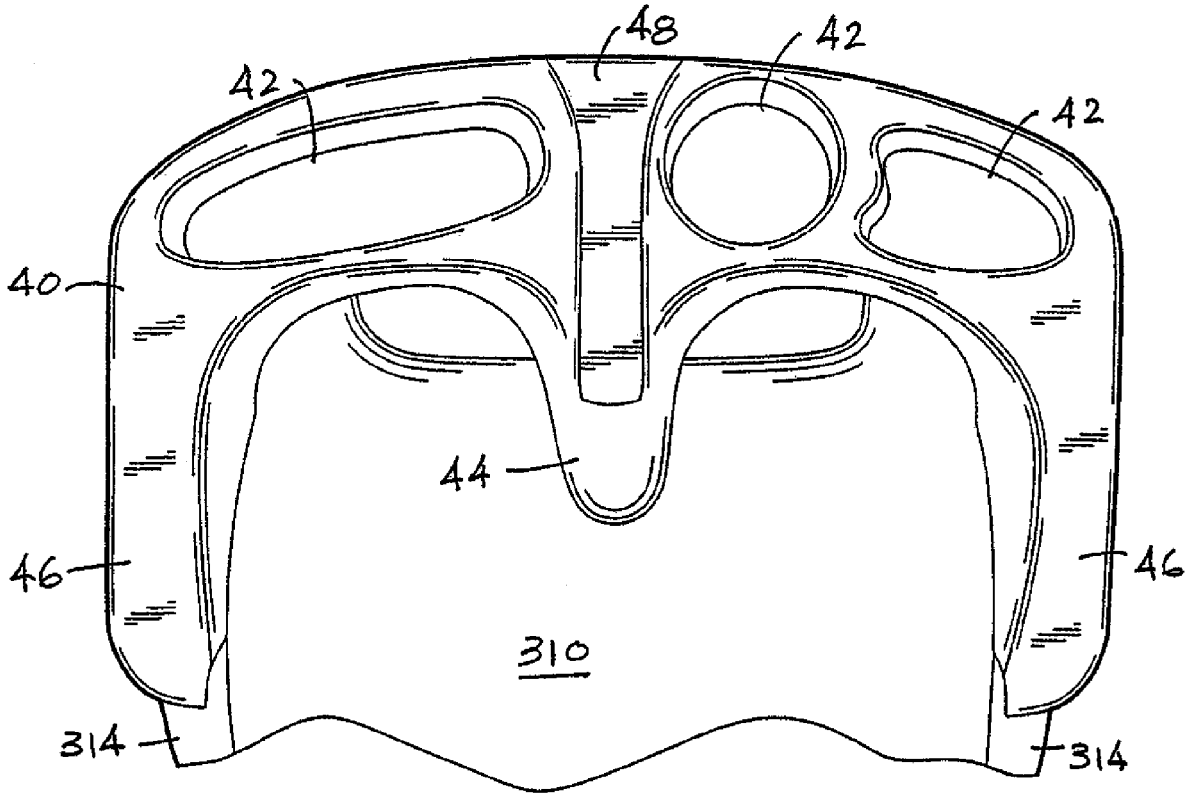
FIG. 7 is a top plan view of a lower tray on which the tray of FIG. 6 rests.

Referring to FIG. 7, armrest portions 314 support the removable arm bar 40. Arm bar 40 is molded of plastic, has various recesses 42, and functions as a small tray. Arm bar 40 also has a depending crotch bar 44, which functions as a restraint to prevent the child occupant from sliding out of the chair. Removable tray 50 is movably supported on the upper side surfaces 46 and a central recessed surface 48 of arm bar 40, as described below.

Tray Features

The tray 50 can include at least one wheel mounted to its underside to rotate for movably supporting the tray 50 on a bearing surface of the chair. For example, referring to FIGS. 6 and 8, the underside of tray 50 can be provided with three wheels: two laterally spaced wheels 502, which ride on side surfaces 46 of arm bar 40, and a center wheel 504, which rides on recessed track 48 of arm bar 40. Each of the wheels is supported on an axle 506, which is carried by webs 508 that are integrally molded into the tray. The wheels facilitate fore/aft adjustment of the tray. Tray 50 is retained on arm bar 40 by tabs 510 that engage the bottom side edges of arm bar 40. Each tab 510 is carried by a side release handle 512, which is pivoted at 514 to the underside of the tray. Side release handles 512 are connected to a central release button 516 at the front of the tray by a pair of flexible but rigid straps 518, which are guided between webs 520 and can transmit force along their length. A spring (not shown) can be housed in release button 516 to bias the button outwardly and, through straps 518, to bias the retaining tabs 510 inwardly to a locking position. To move the tray, the caregiver need only press the release button 516 inwardly (or squeeze handles 512 upwardly) to unlock retaining tabs 510, whereupon the tray can be rolled fore or aft on wheels 502 to a new position and locked there.

Figure 2:
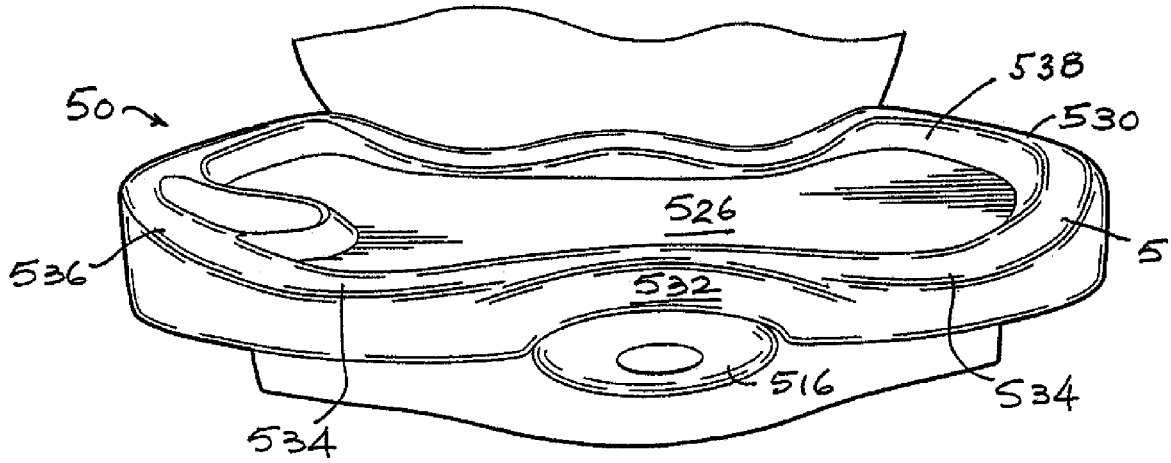
FIG. 2 is a front perspective view of a tray according to the invention.
Figure 3:
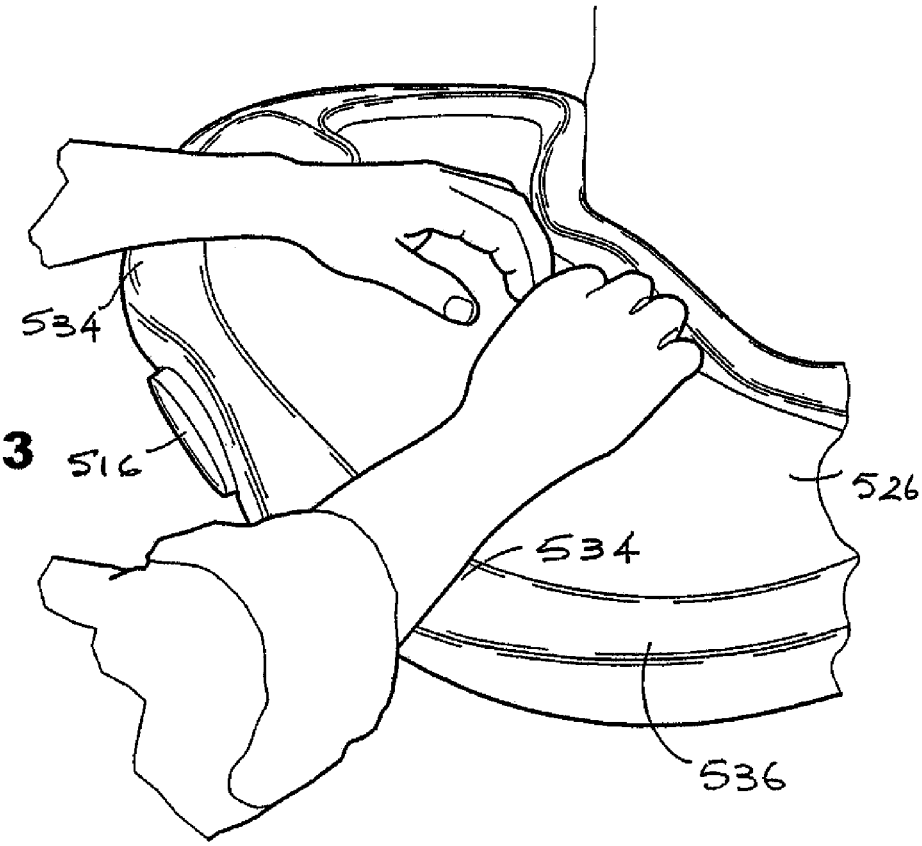
FIG. 3 is a top perspective view of the tray of FIG. 2.

The front of the tray 50 is ergonomically contoured to enhance comfort for the caregiver. Referring to FIGS. 2 and 3, central portion 526 of tray 50 is surrounded by a raised rim 530, and the front of the rim has an undulate height profile. Specifically, the medial portion 532 of the rim is higher than the two adjacent rest portions 534, and the rest portions 534 are flanked by higher shoulder portions 536. The rest portions 534 have gently curved upper surfaces and rounded upper edges. These features cradle the caregiver's hands or arms quite comfortably, as shown in FIG. 3.

Further, as can be seen in FIG. 2, the central portion 526 of the tray 50 gently slopes upward to the upper edge of rim 530. That is, the inner surface 538 of rim 530 is angled, rather than perpendicular, relative to central portion 526 and the upper edge of rim 530 to make wiping away of food scraps from the central portion 526 over rim 530 easier.

Figure 4:
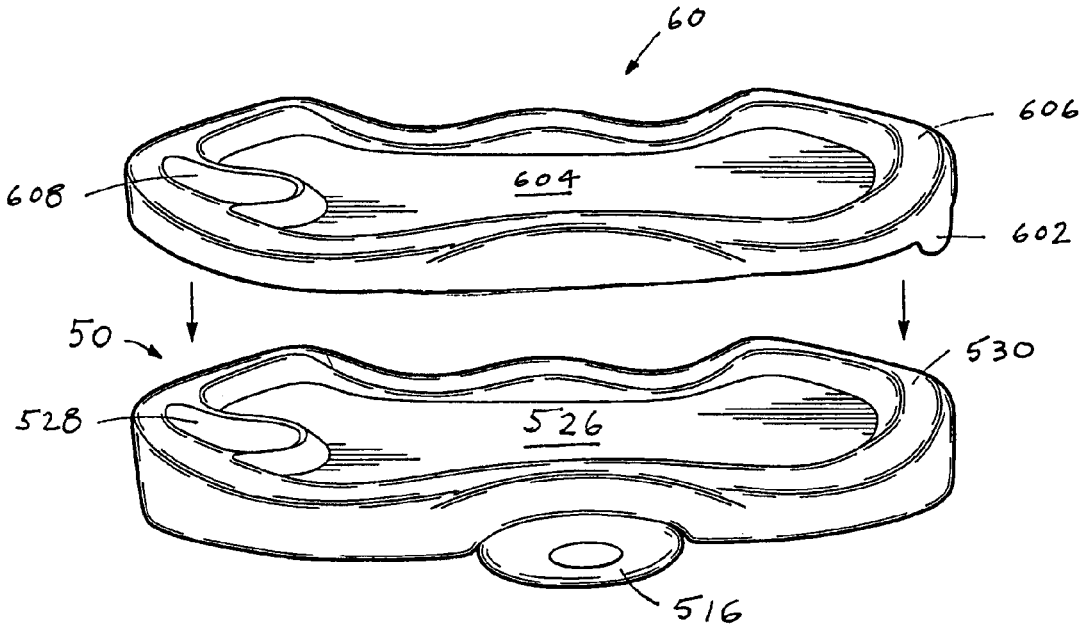
FIG. 4 is a front perspective view of a tray and a raised tray insert according to the invention.
Figure 5:
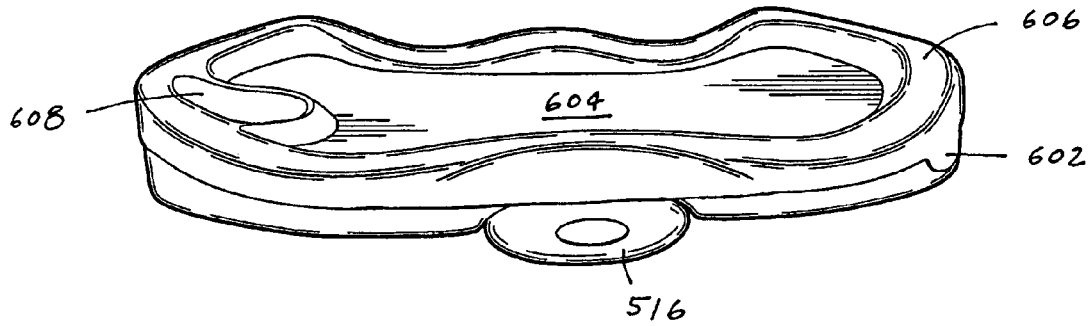
FIG. 5 is a front perspective view similar to FIG. 4, showing the tray insert in position on the tray.

Referring to FIGS. 4 and 5, tray cleaning after meals or other activities is facilitated by a removable flexible tray insert or liner 60 that fits onto tray 50. Insert 60 is molded of a flexible plastic or rubberized material that is shaped generally to conform to and cover the central portion 526 of the tray. The insert 60 also can be shaped generally to conform to and cover at least the immediately adjacent portions of the rim 530 of the tray. The insert 60 includes a central (major) portion 604 to cover the central portion 526 of the tray 50 and a raised rim 606 surrounding the central portion 604. The raised rim 606 can cover at least the immediately adjacent portions of the rim 530. In one embodiment, as shown in FIG. 5, the raised rim 606 extends over and completely covers the rim 530 of the tray 50. A convenience tab 602 facilitates removal of the insert. Insert 60 thus can readily be removed from tray 50, carried to a trash receptacle, and flexed and tilted to channel food scraps or other debris to the center and one edge of the insert (as is commonly done, for example, with table place mats) for easy disposal of the debris. In addition, the insert 60 is flexible enough to fit, when folded, into a standard-sized homeowner's sink, which facilitates clean-up. The central portion 604 of insert 60 is substantially flat, such that the insert 60 can be stably supported on any flat surface, e.g., a table, as a rimmed place mat when removed from the tray. The insert 60 is can be made of a material that has a relatively high coefficient of friction so that it will not slip or slide easily on a table or other surface. The insert 60 can include a recess 608 to hold a beverage. The recess 608 can be received in a beverage recess 528 of the tray 50. Additional recesses can be provided to enhance the versatility of the insert 60.

Chair Height Adjustment

Figure 9:
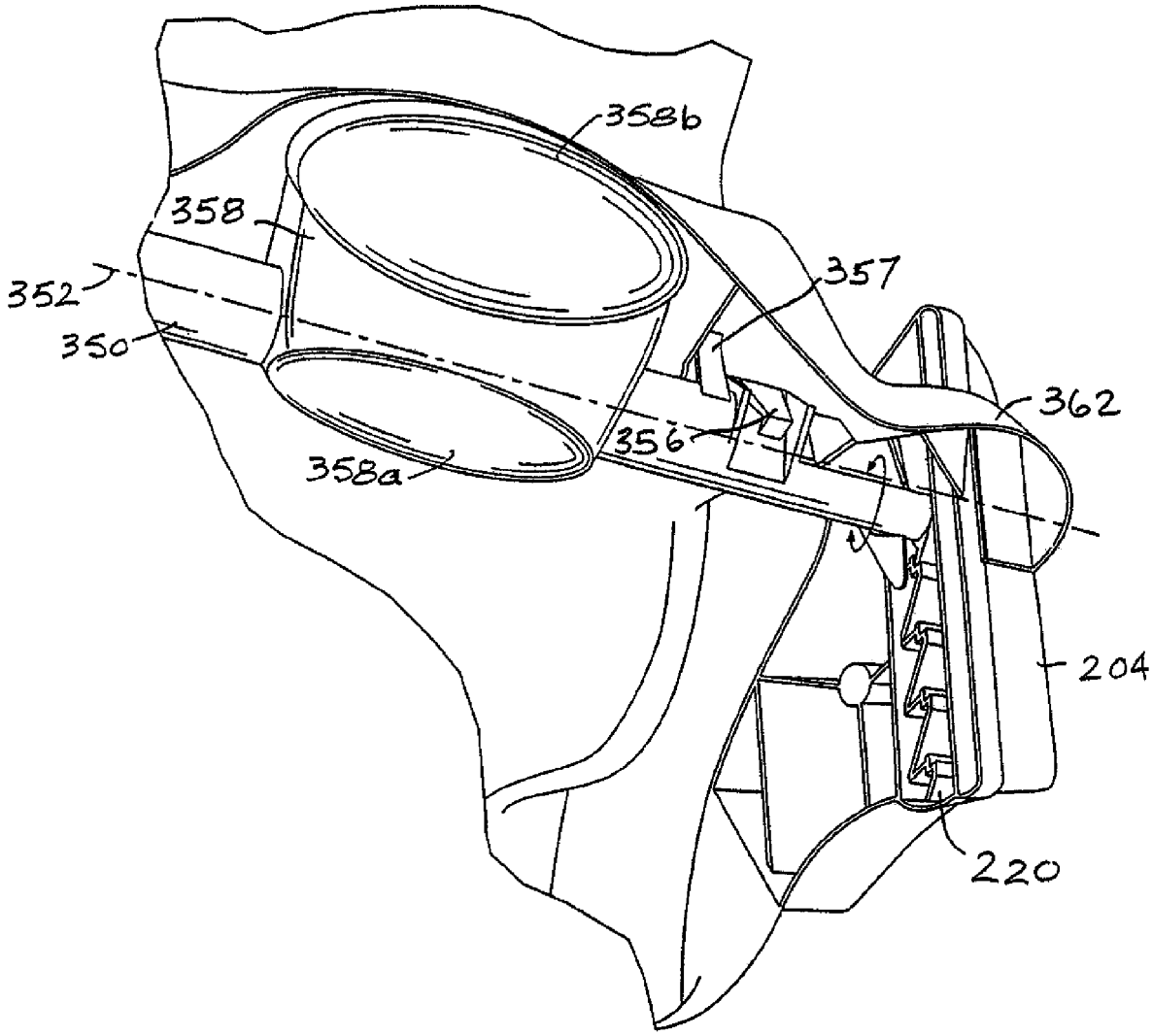
FIG. 9 is a bottom perspective view of the chair of FIG. 1, showing a portion of the height adjustment mechanism according to the invention.
Figure 10:
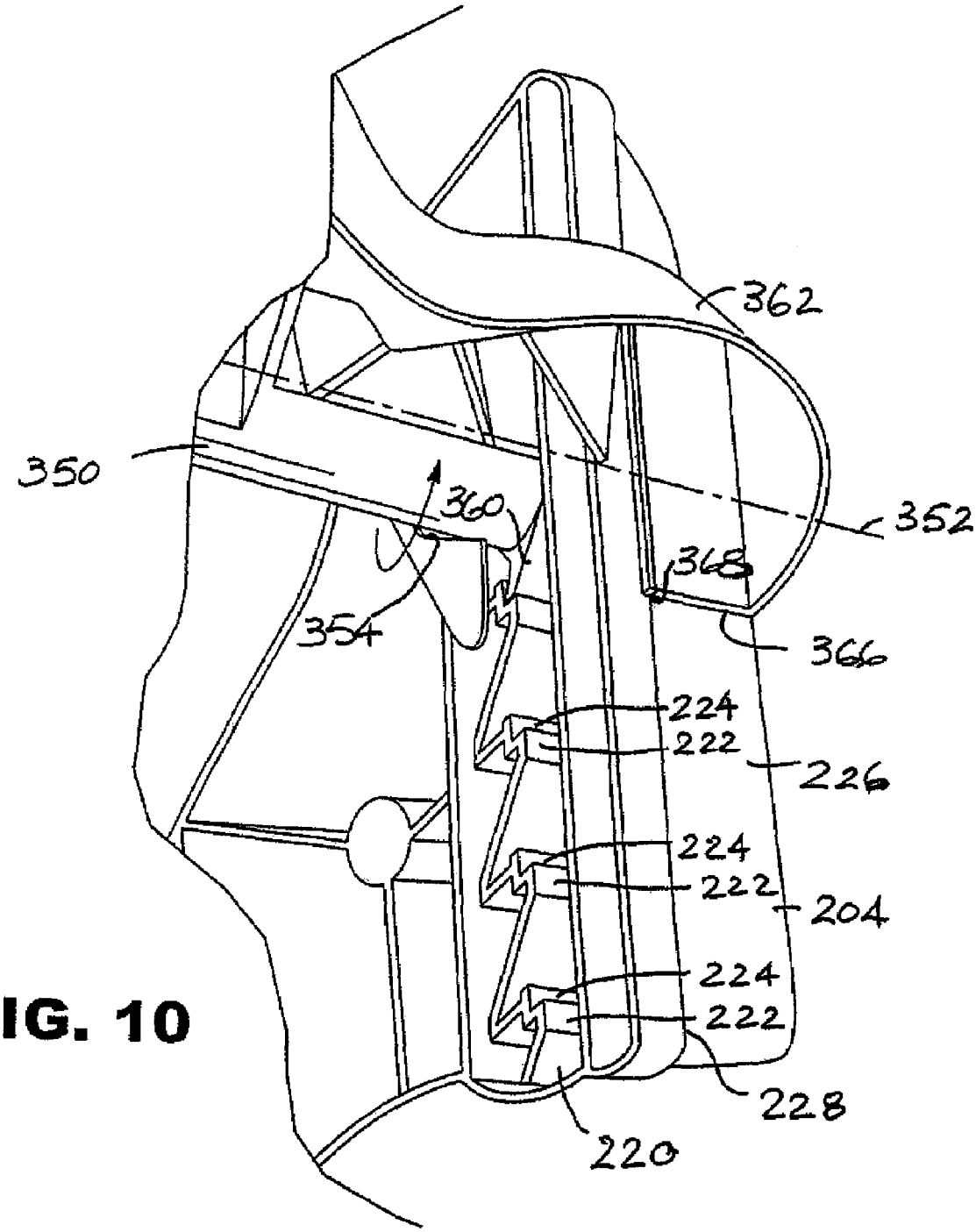
FIG. 10 is a detail perspective view similar to FIG. 9, showing the height adjustment mechanism in the latched condition.
Figure 11:
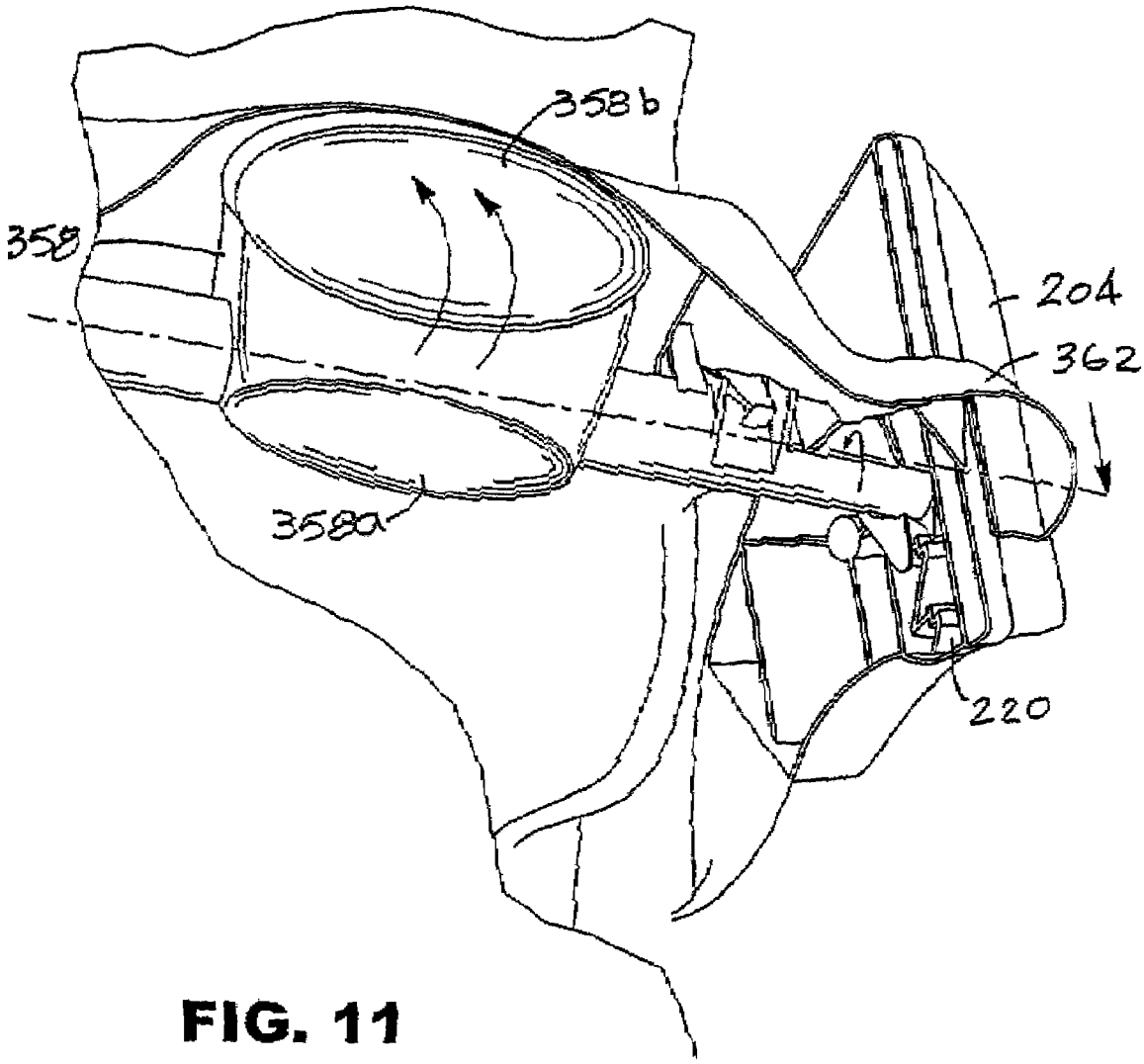
FIG. 11 is a detail perspective view similar to FIG. 10, showing the height adjustment mechanism in the unlatched condition.

FIGS. 9-11 depict the features that enable one-handed adjustment of the height of the seat 30 relative to the frame 20. The inboard face of each chassis side portion 204 has an integrally molded rack 220 with a series of vertically spaced teeth 222. Each tooth 222 has a support shoulder or ledge 224 that is adapted to bear one half the weight of the seat. A rear bearing surface 226 and a shoulder 228 on chassis side portion 204 serve to guide and locate seat 30.

A transverse bar 350 is pivoted about its longitudinal axis 352 to the bottom rear of seat 30 in a U-shaped recess 354 at each side of the seat. A retaining tab 356 at each side helps to keep bar 350 in position in recesses 354, while allowing the bar 350 to pivot. A tooth 360 at each end of bar 350 engages the shoulder 224 of a selected tooth 222 in its respective rack 220. A leaf spring 357 biases transverse bar 350 to the latched position, i.e., the position in which teeth 360 engage teeth 222 (see FIG. 10). A central handle 358 is integral with transverse bar 350. Handle 358 has a grip portion 358*a* adapted to be grasped by the fingers of a hand, and a heel portion 358*b* adapted to be engaged by the heel of the hand when the fingers engage grip portion 358*a*. A curved extension 362 at each side of seat 30 wraps around the respective chassis side portion 204. The extension 362 has a bearing surface 366 and a shoulder 368 that mate with bearing surface 226 and shoulder 228, respectively.

Figure 12:
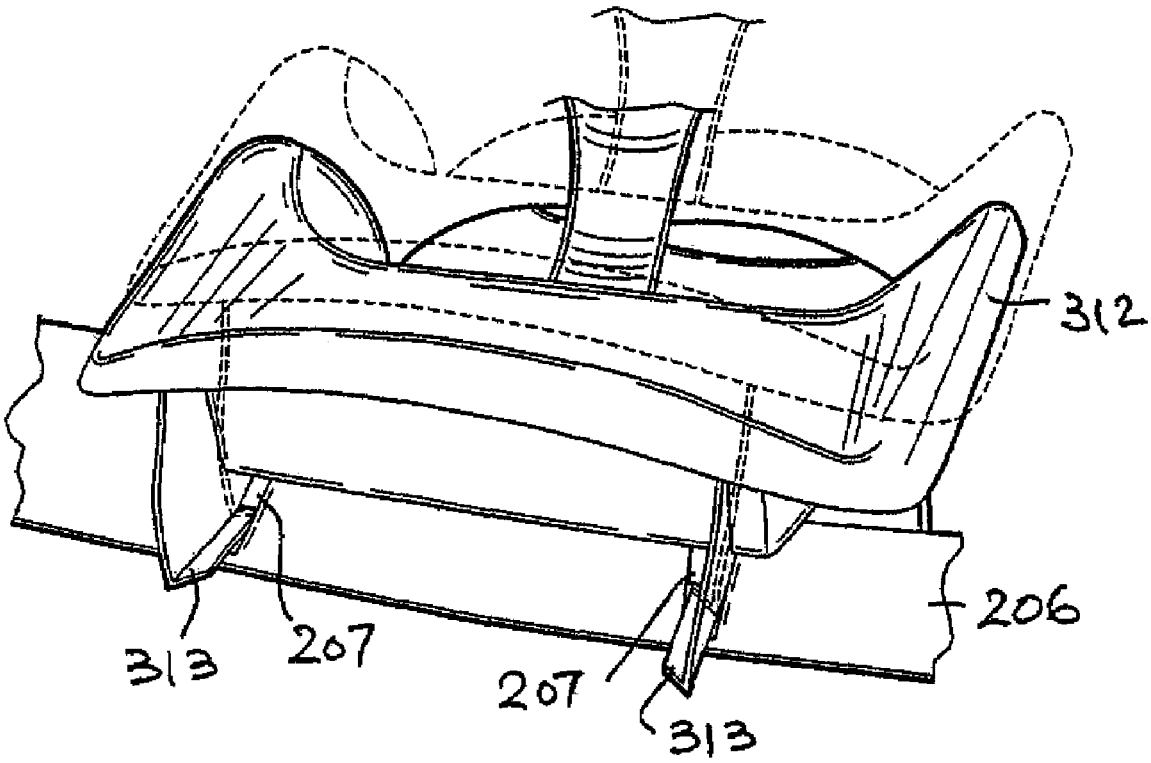
FIG. 12 is a bottom perspective view of the leg rest portion of the chair of FIG. 1 and the support for the leg rest portion.

To change the height of seat 30, central handle 358 is grasped by a single hand, with the fingers wrapped around grip portion 358*a* and the heel of the hand engaging heel portion 358*b*. Heel portion 358*b* is then raised, which pivots transverse bar 350 in the direction of the arrows in FIGS. 10 and 11 to move teeth 360 out of engagement with teeth 222 (see FIG. 11). Substantially the entire weight of the seat (and the seat occupant) can be borne by the fingers that engage the grip portion 358*a* of handle 358, whereby the seat can be raised or lowered by one hand to a new position. When the new position is reached, handle 358 is released, which allows bar 350 to pivot back to the latched position with teeth 360 in engagement with new teeth 222. The mating bearing surfaces 226, 366 help to resist downward tilting of seat 30. Additional stability for seat 30 is provided by chassis front cross member 206 (see FIG. 12), which has guiding support slots 207 that slidably engage support flanges 313 on leg rest portion 312. The dashed lines in FIG. 12 illustrate how the leg rest portion 312 moves relative to the front cross member 206.

Recline Features

Figure 13:
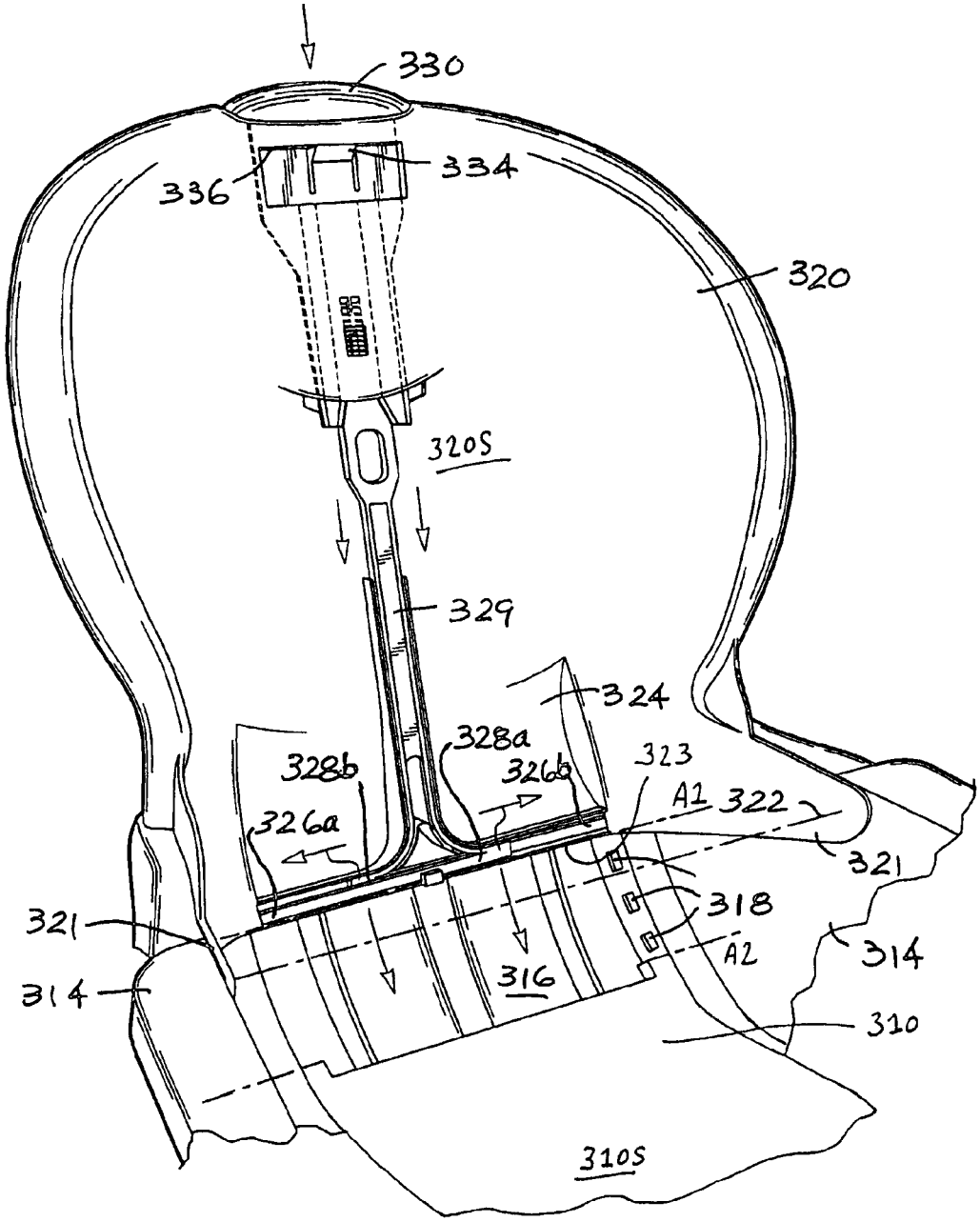
FIG. 13 is a perspective view of portions of the seat of the chair of FIG. 1.
Figure 14:
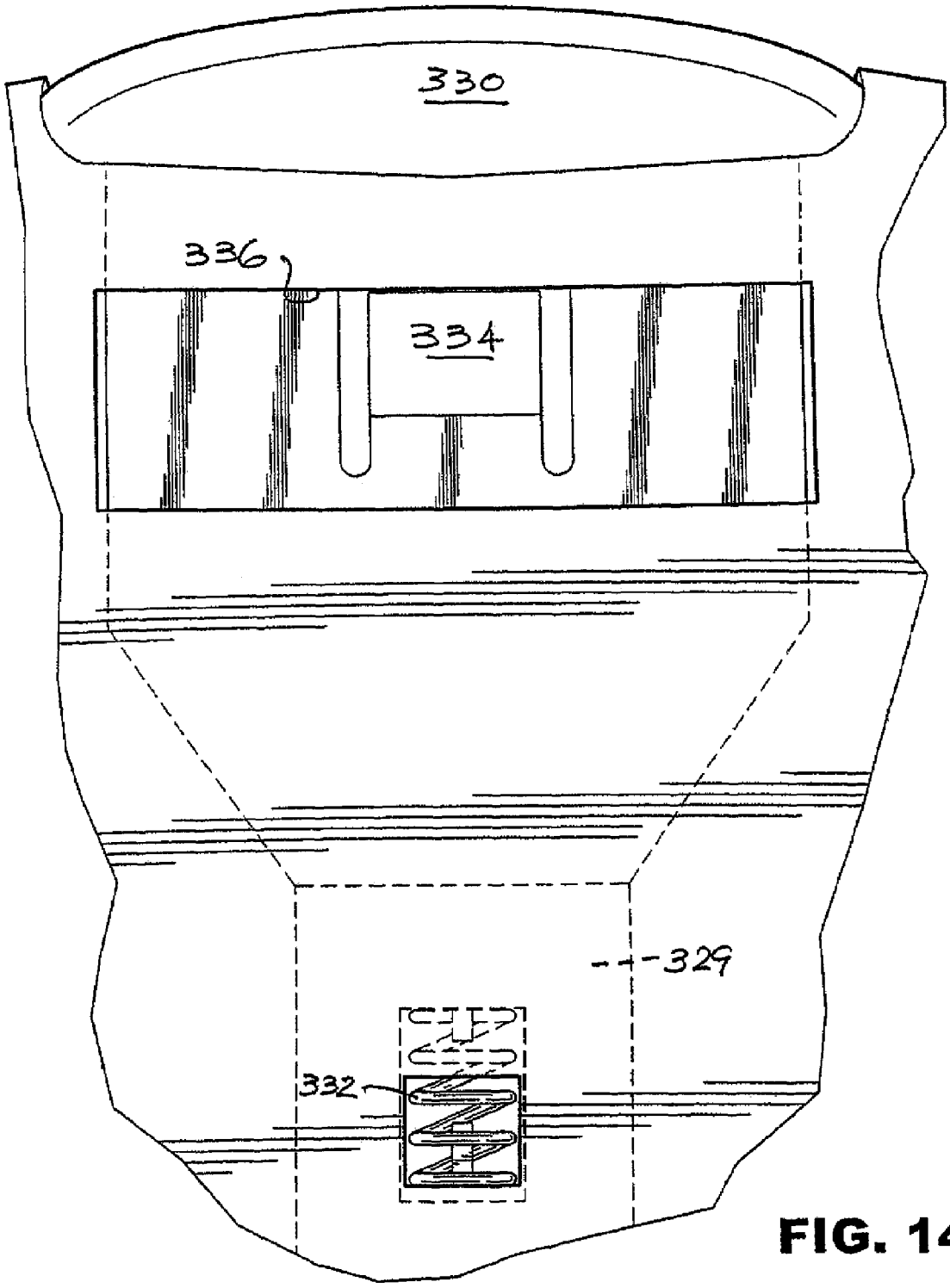
FIG. 14 is a front elevational view of the backrest portion of the seat.

FIGS. 13 and 14 depict the recline features of the high chair. The seat back portion 320 is pivotally mounted to the seat bottom portion 310 about a transverse pivot axis, for example, axis 322, to move between an upright position (as shown in FIG. 14) and a reclined position. The seat back portion 320 and seat bottom portion 310 together define a seat bight region, generally indicated 316, along the seat bottom portion 320. The seat bight region 316 is defined as the region between a first transverse axis A1 of the seat bottom portion 310, where a lower edge 323 of the seat back portion 320 intersects the seat bottom portion 310 when the seat back is in the upright position, and a second transverse axis A2 of the seat bottom portion 310, where the lower edge 323 intersects the seat bottom portion 310 when the seat back is the reclined position. The pivot axis 322 is located above and forwardly of this seat bight region, as can be seen in FIGS. 1 and 13. According to another aspect of the invention, the pivot axis 322 is located above and forwardly of the lower edge 323 of the seat back portion 320 throughout the range of adjustment of the seat back portion 320.

Seat back portion 320 has integrally molded lateral tabs or extensions 321 that extend forwardly and are pivoted to armrest portions 314 about the pivot axis 322. As compared to a conventional arrangement in which the seat back is hinged to the seat bottom in the seat bight region, the geometry of chair 10 substantially lessens the rearward excursion of the seat back portion 320 when reclined. This minimizes the rearward shift of the center of gravity of the occupied high chair, whereby the high chair can meet stability requirements with a smaller footprint. The rear portion of seat bottom portion 310 is curved upwardly, in the seat bight region 316, and the bottom 324 of seat back portion 320 is similarly curved so as to slide closely past the seat bottom portion 310 throughout the range of adjustment of the seat back portion 320.

The seat back portion 320 can be selectively locked in various positions. This is facilitated by a series of notches 318 near each side of the seat bight portion 316 of seat bottom portion 310. The notches 318 are engaged by retractable bolts 326*a*, 326*b* carried by seat back portion 320. These bolts 326*a*, 326*b* are essentially the ends of guided flexible, but rigid, straps 328*a*, 328*b*, similar to those used on the underside of tray 50 (see FIG. 6). The straps 328*a*, 328*b* are connected to a central release button or handle 330 at the top of seat back portion 320 through a central strap 329, which is bifurcated and laterally directed at its bottom to engage straps 328*a*, 328*b*. As seen in FIG. 14, bolts 326*a*, 328*b* are biased into engagement with notches 318 under the influence of a coil spring 332, which acts on straps 328*a*, 328*b* indirectly through central strap 329. Downward pressure on release button 330 moves central strap 329 downwardly against the action of spring 332. This downward movement is translated into a lateral pulling movement of straps 328*a*, 328*b* as indicated by the arrows in FIG. 13, whereby the bolts 326*a*, 326*b* are retracted from the notches 318. A stop 334 associated with release button 330 engages a window edge 336 in seat back portion 320 to limit upward movement of the release button.

The seat bottom portion 310 has a seating surface 310S upon which a child sits, and the seat back portion 320 has a back support surface 320S against which a child can lean its back. According to another further of the invention, the pivot axis 322 is located above the seating surface 310S and forwardly of the back support surface 320S throughout the range of adjustment of the seat back portion 320. The seating surface 310S can have a centerline (not shown) that bisects the seat bottom portion 310 into left and right halves and that extends from a front edge of the seat bottom portion 310 to the front edge of the seat bight region 316. Likewise, the back support portion 320 can have a centerline (not shown) that bisects the back support portion 320 into left and right halves. According to yet another aspect of the invention, the pivot axis 322 is located above the portion of the seating surface 320S along its centerline and forwardly of the portion of the seat back portion 310 along its centerline.

As can be seen from FIG. 13, the angle of the seat back portion 320 relative to the seat bottom portion 310 varies, as the seat back portion 320 moves between the upright position and the reclined position, throughout its range of adjustment.

Yet the distance between the seat back portion and the crotch support is not significantly altered.

Seat-to-Tray Height Adjustment

Figure 15:
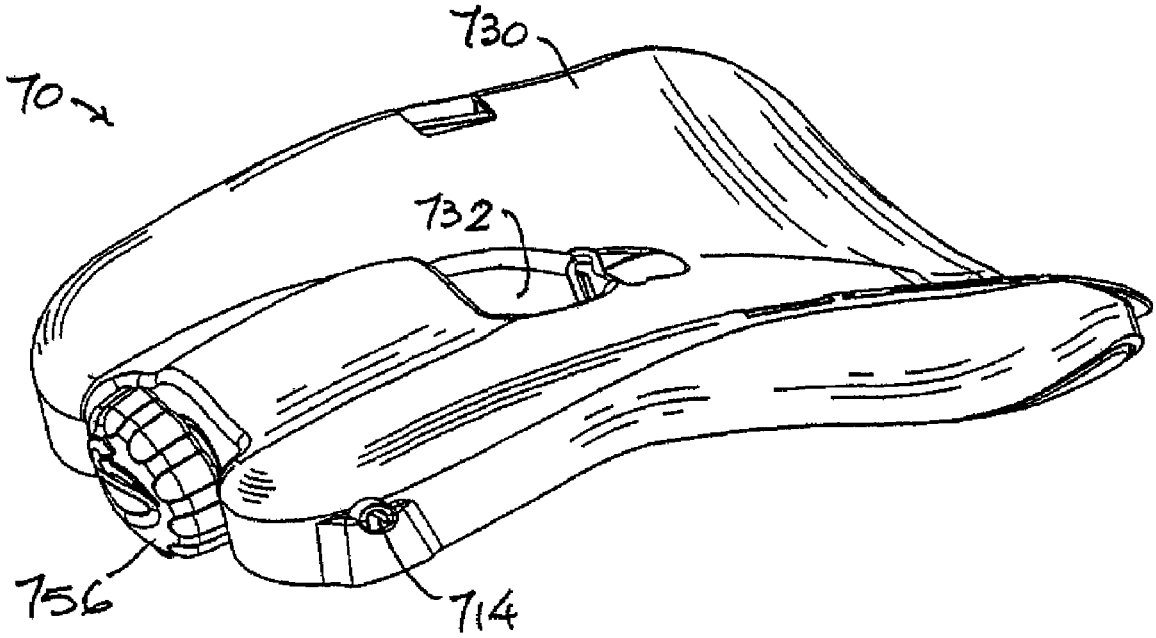
FIG. 15 is a perspective view of an adjustable seat assembly according to the invention.
Figure 16:
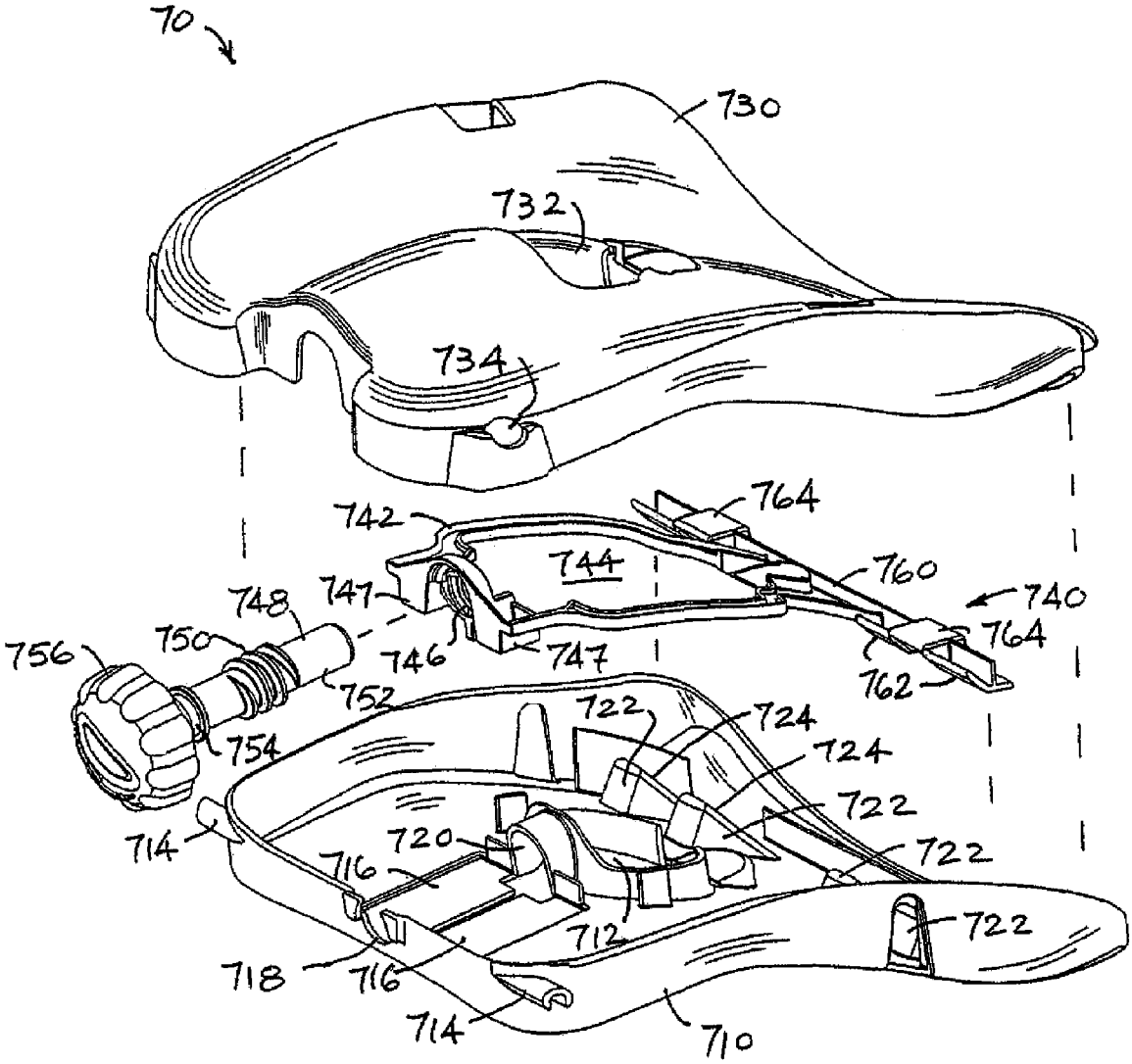
FIG. 16 is an exploded view of the seat assembly of FIG. 15.
Figure 17:
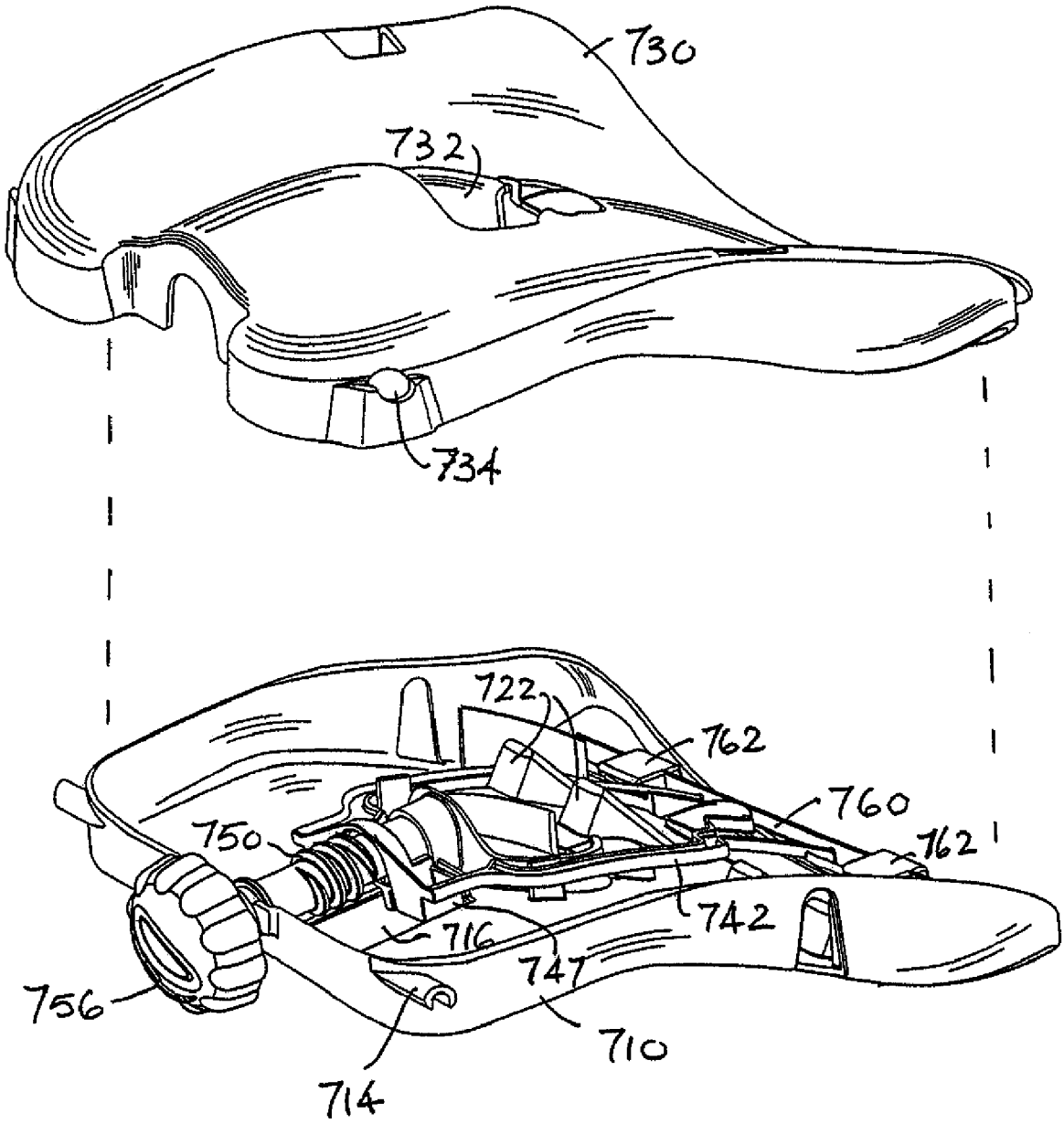
FIG. 17 is partial assembly/exploded view of the seat assembly of FIG. 15.
Figure 18:
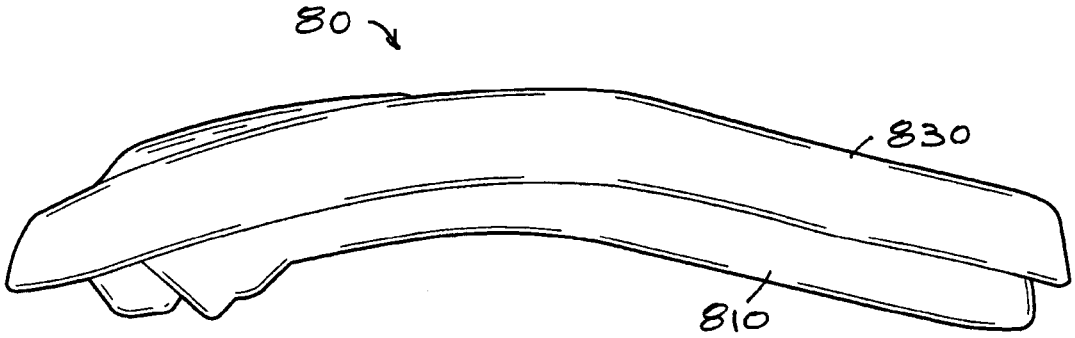
FIG. 18 is a side elevational view of another form of adjustable seat assembly according to the invention, shown in its lowest (collapsed) configuration.
Figure 19:
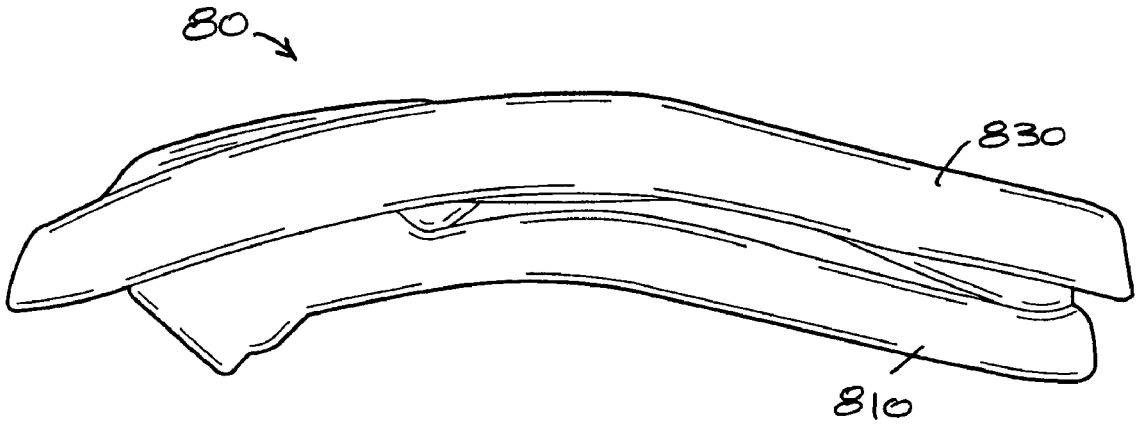
FIG. 19 is a view similar to FIG. 18, showing the seat assembly of FIG. 18 in an elevated (expanded) configuration.
Figure 20:
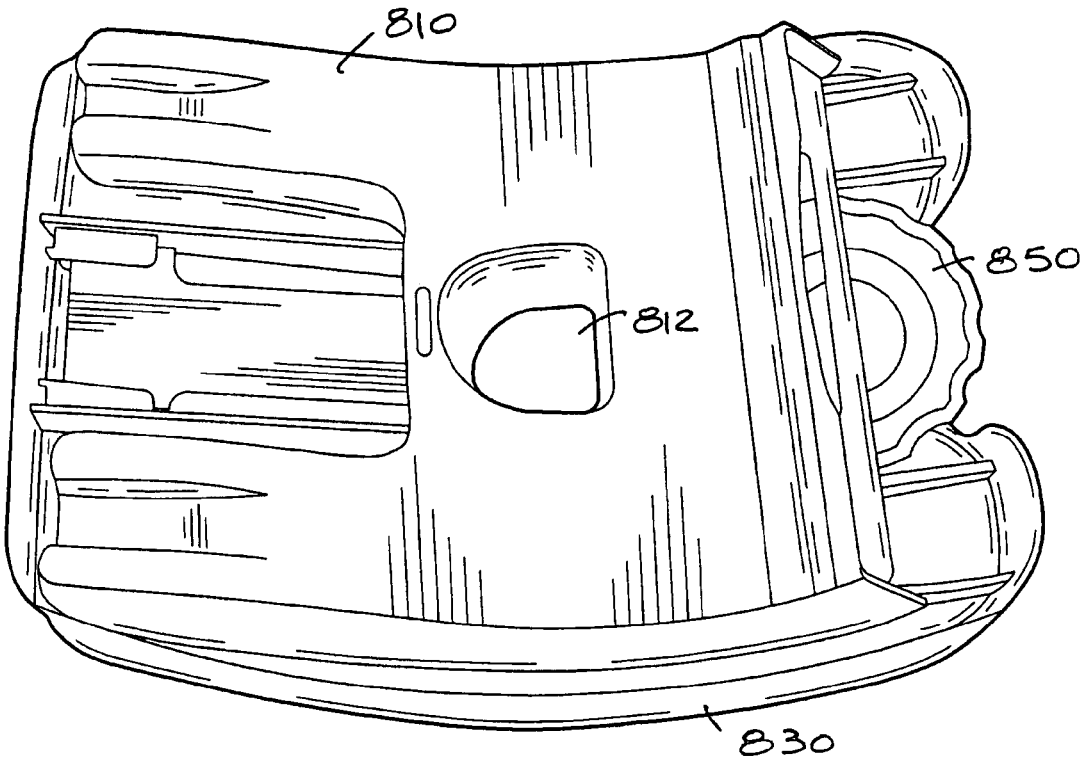
FIG. 20 is a bottom perspective view of the seat assembly of FIG. 18.
Figure 21:
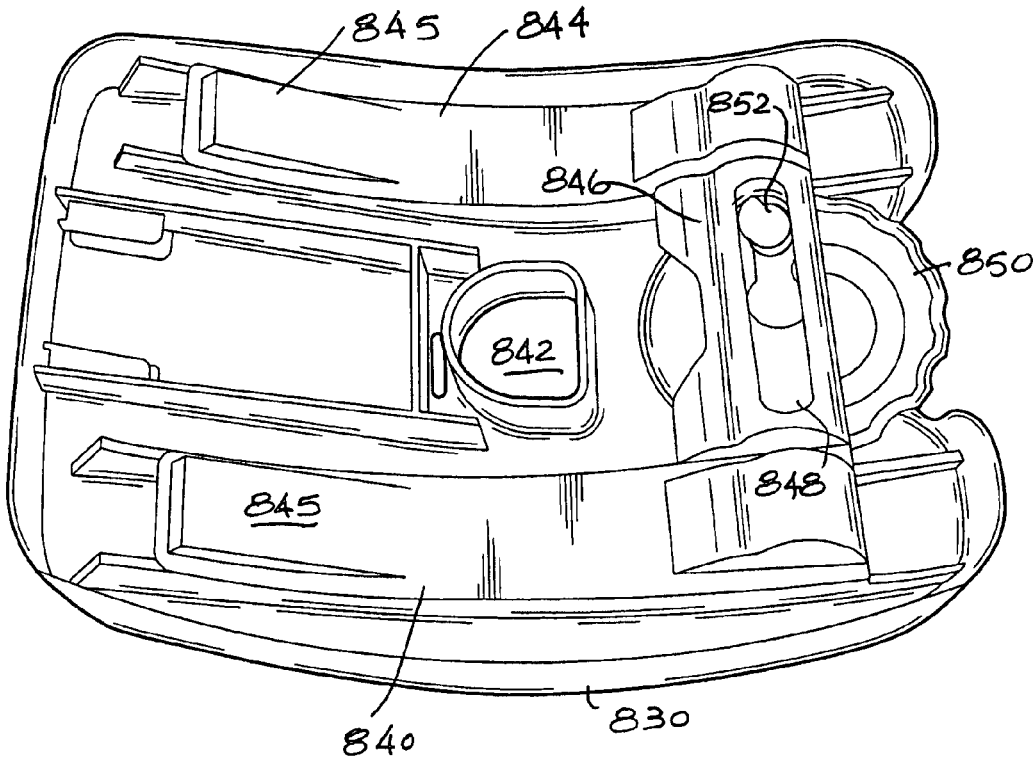
FIG. 21 is a bottom perspective view of the seat assembly of FIG. 18, with the base removed.

FIGS. 15-17 depict a first embodiment 70 of an adjustable seat assembly that is adapted to support the chair occupant at a selected height relative to the tray. As best seen in FIG. 16, seat assembly 70 comprises three main components: a base 710 adapted to rest on seat bottom portion 310; a seat platform 730 adapted to overlie base 710 and support the occupant; and an intermediate elevating mechanism 740 for adjusting the height of the seat platform relative to the base. These components can be made of injection molded plastic material. Base 710 is upwardly dished and has a central opening 712 that accommodates crotch bar 44 (see FIGS. 1 and 7) and a webbed crotch restraint, if so equipped. Seat platform 730 also has a crotch bar hole 732 that serves the same purpose. Side studs 714 on base 710 extend through side holes 734 in seat platform 730 to keep the parts from separating, and the studs 714 can be used to secure the seat assembly to the seat bottom portion 310 by suitable means (not shown). A front notch 718 is aligned with a central recess 720, and both of these structures cooperate with a portion of the elevating mechanism 740, as described below. A plurality of wedges 722 have ramped surfaces 724 over which a portion of the elevating mechanism rides. The elevating mechanism is guided in two parallel notches 716 in base 710.

Elevating mechanism 740 comprises a frame 742 surrounding a large central aperture 744 (through which crotch bar 44 can pass). At the front of frame 742 is a threaded hole 746 flanked by guide feet 747. A shaft 748 has a threaded portion 750 that engages threaded hole 746, with the rear end 752 of shaft 748 captured in recess 720. The shaft 748 also has a groove 754 captured in the front notch 718 of base 710. A knob 756 at the front end of shaft 748 facilitates rotation of shaft 748, which moves frame 742 fore or aft. At the rear of frame 742 is a bar 760 with lower surfaces 762, which ride on ramps 724, and upper surfaces 764, which support seat platform 730. Thus, as knob 756 is turned, frame 742 and bar 760 move fore or aft over wedges 722 to change the height of seat platform 730.

A second adjustable seat assembly embodiment 80 is shown in FIGS. 18-21. The embodiment 80 also comprises a base 810, a seat platform 830, and an adjusting mechanism 840. In this embodiment, the element that moves fore and aft to adjust seat platform height is a U-shaped slide 844 (see FIG. 21) that has wedges 845. Crotch bar holes 812, 842 are provided, as in the first embodiment. Slide 844 has a front cross member 846 with a slot 848. A wheel 850 is centrally pivoted to the underside of seat platform 830, and has an eccentric pin 852 that resides in slot 848. Rotation of wheel 850 moves pin 852, which moves slide 844 with its wedges fore or aft, thus causing the height of seat platform 830 to change.

Accessory Bar

Figure 22:
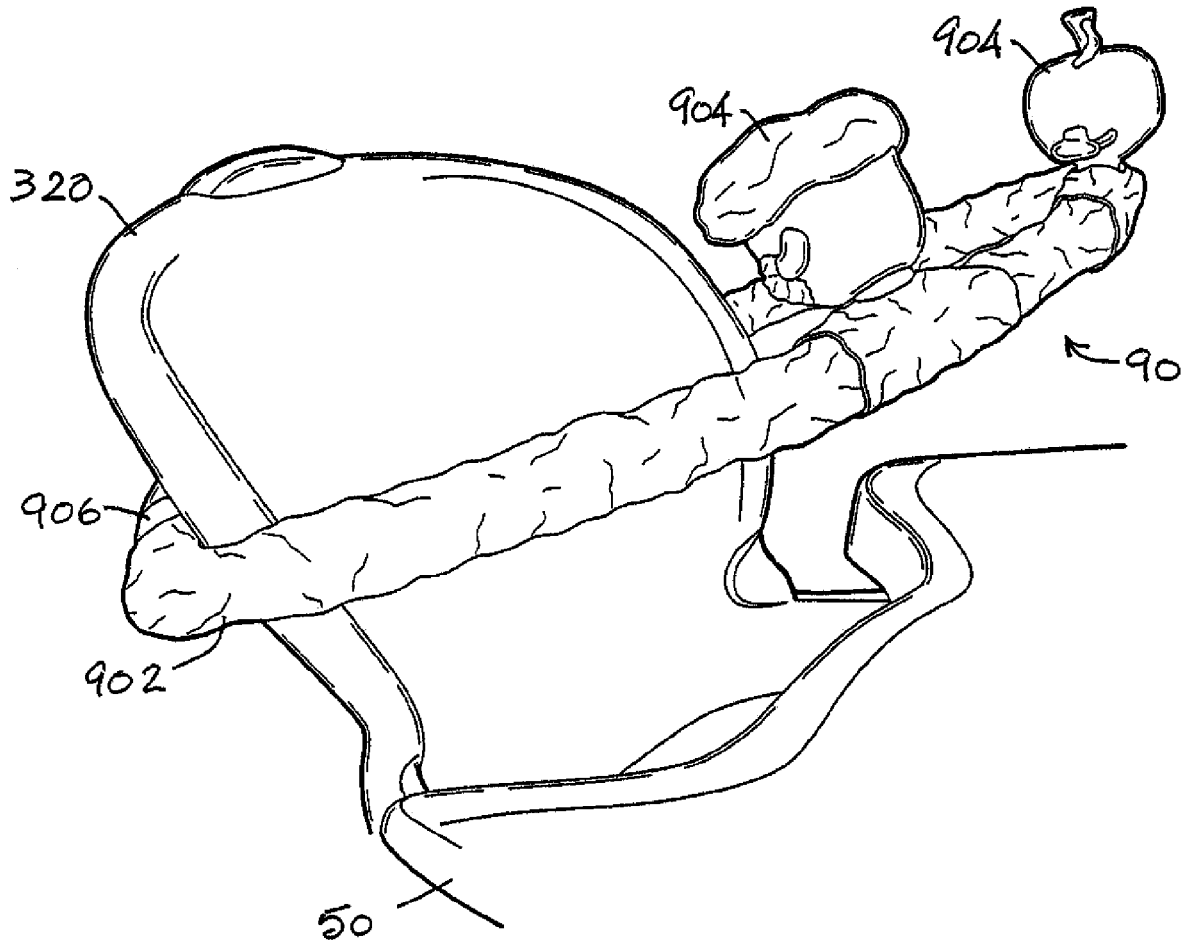
FIG. 22 is a perspective view of the accessory bar according to the invention, shown in the forward position.
Figure 23:
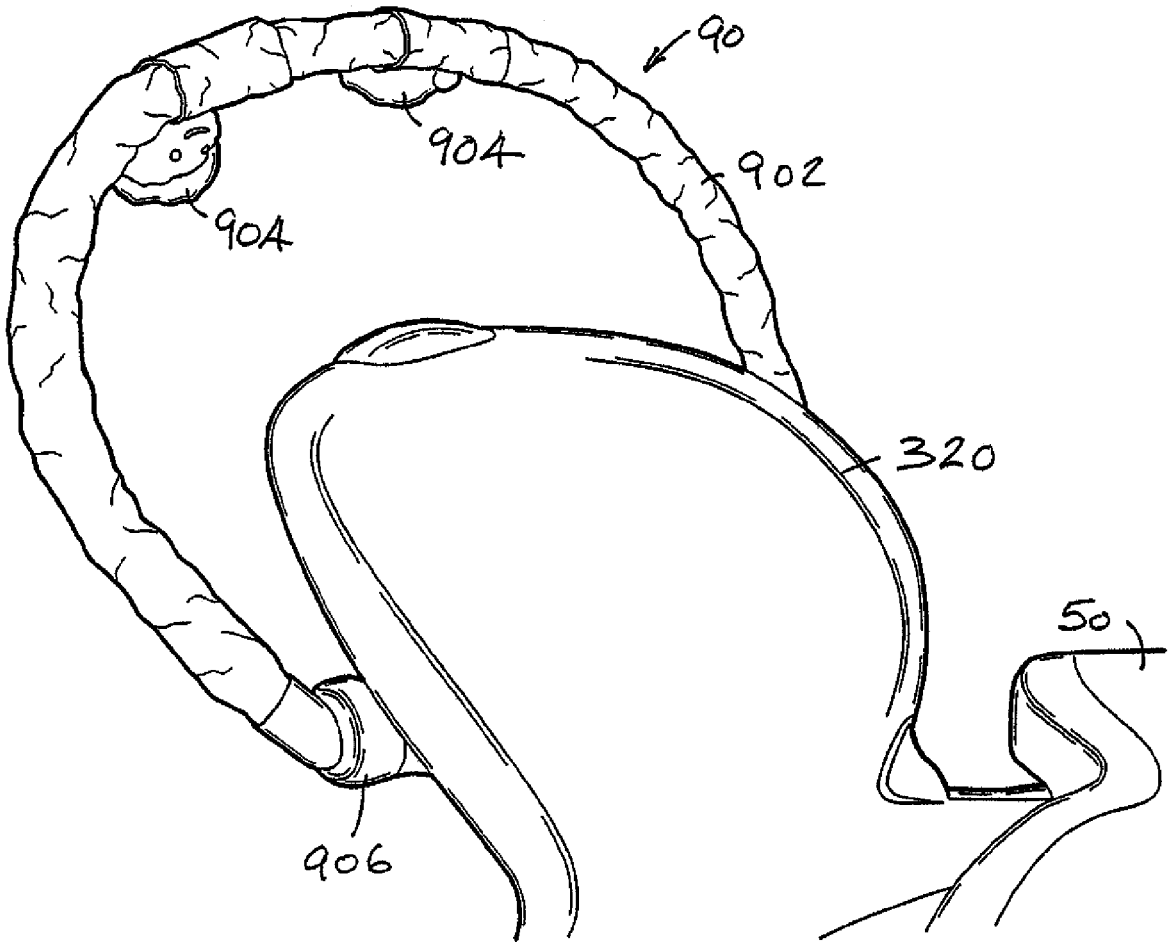
FIG. 23 is a perspective view of the accessory bar of FIG. 22, shown in the raised position.

FIGS. 22 and 23 depict a U-shaped accessory bar 90 and its use. Accessory bar 90 can be made of plastic or other suitable stiff and lightweight material. Accessory bar 90 is shown covered by a soft sleeve 902 and supporting a number of toys 904. The ends 906 of bar 90 are pivoted to the seat, for example, to the seat back portion 320 as shown, about a transverse axis. Any suitable pivots may be used. Each pivot can have two stops that limit movement of the bar 90. The first stop keeps the bar from dropping onto the tray 50 when the bar is in the forward (use) position (FIG. 22). The second stop keeps the bar from dropping rearwardly below the upright (inactive) position (FIG. 23). Thus, the accessory bar with its toys or other appendages can be quickly swung down in front of the seat occupant, or quickly moved out of the way to the upright position. In addition, the pivot connection of the bar 90 to the seat back portion 320 can be a break-away connection so that, if the bar 90 inadvertently is pivoted rearwardly past the second pivot, a predetermined force on the bar 90 (for example, a force applied by a curious child attempting to hang on, or step on, the bar 90) allows the bar 90 to break-away from the seat back portion 320. In this manner, the high chair 10 will not be pulled over, rearwardly, if such force is applied to the bar 90.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A height-adjustable child high chair comprising:

a seat including a seat bottom portion and a seat back portion, the seat bottom portion having a downwardly extending leg rest portion;

a floor-engaging frame supporting the seat, the frame supporting the leg rest portion such that the leg rest portion is slidable relative to the frame; and a seat height adjustment mechanism facilitating vertical movement of the seat relative to the frame, wherein the seat height adjustment mechanism includes a rack with vertically spaced support elements at each side of the frame, a latch assembly carried by the seat, the latch assembly having a bar with at least one tooth, the at least one tooth of the latch selectively engageable with a selected support element of the rack, and a handle operatively connected to the bar to pivot the bar between a latched position with the at least one tooth of the latch engaged with the rack and an unlatched position with the at least one tooth of the rack disengaged from and slidable relative to the rack.

2. The height-adjustable child high chair as recited in claim 1, wherein the handle includes a grip portion adapted to be engaged and supported by the fingers of one hand, and a heel portion adapted to be raised by the heel of the same hand when the grip portion is engaged.

3. The height-adjustable child high chair as recited in claim 1, wherein the seat and the frame have mating guide surfaces that are in contact throughout a range of seat height adjustment, and wherein the guide surfaces resist tilting of the seat relative to the frame.

4. A height-adjustable child high chair comprising:

a seat;

a floor-engaging frame including opposing side portions at opposite sides of the seat; and a height-adjustable support assembly connecting the seat and the frame, the support assembly including a toothed rack disposed at each side portion of the frame;

a latch carried by the seat, the latch including a pair of teeth, one each configured to selectively engage a respective one of the racks; and a handle operatively connected to the latch and rotatable about an axis for rotating the latch about the axis between a latched position whereby the pair of teeth carried by the seat are interlocked in the corresponding rack, and an unlatched position whereby the pair of teeth carried by the seat are free from the corresponding rack such that the seat can be moved vertically with respect to the frame.

5. The height-adjustable child high chair as recited in claim 4, wherein the handle is substantially centrally located on the seat.

6. The height-adjustable child high chair as recited in claim 4, wherein the latch comprises a transverse bar supporting the seat and the handle is disposed on the bar.

7. The height-adjustable child high chair as recited in claim 6, wherein the handle comprises a grip portion adapted to be engaged and supported by the fingers of one hand, and a heel portion adapted to be raised by the heel of the same hand when the grip portion is engaged, and wherein movement of the heel portion unlatches the teeth with respect to the rack to permit vertical movement of the seat relative to the frame.

8. The height-adjustable child high chair as recited in claim 4, wherein the seat and the frame have mating guide surfaces that are in contact throughout the range of seat height adjustment, and wherein the mating guide surfaces resist tilting of the seat.

9. A height-adjustable child high chair comprising:

a seat;

a floor-engaging frame supporting the seat; and a seat height adjustment mechanism facilitating vertical movement of the seat relative to the frame, the seat height adjustment mechanism including plural support elements on one of the seat and the frame, a latch assembly on the other of the seat and the frame, the latch assembly engageable with a selected support element of the plural support elements to position the seat at a selected height location, and a handle operatively connected to the latch assembly to rotate the latch assembly about an axis to pivot the latch assembly into and out of engagement with the selected support element to selectively move the seat to an adjusted height location.

* * * * *